US005245397A

United States Patent [19]

Mahoney

[11] Patent Number: 5,245,397

[45] Date of Patent: Sep. 14, 1993

[54] REPRODUCTION APPARATUS HAVING A TAB STOCK FEEDING INTERMEDIATE STORAGE TRAY ASSEMBLY

[75] Inventor: Gregory P. Mahoney, Fairport, N.Y.

[73] Assignee: Eastman Kodak Company, Rochester, N.Y.

[21] Appl. No.: 942,906

[22] Filed: Sep. 10, 1992

[51] Int. Cl.[5] ..... G03G 21/00

[52] U.S. Cl. ..... 355/325; 355/309

[58] Field of Search ..... 355/325, 309, 317, 318, 355/319, 308, 311; 271/3, 226, 113, 109; 101/232

[56] References Cited

U.S. PATENT DOCUMENTS 4,019,435 4/1977 Davis ..... 101/232
4,078,489 3/1978 David ..... 101/141
4,819,021 4/1989 Doery .
4,974,035 11/1990 Rabb et al. ..... 355/320
5,014,977 5/1991 Moore et al. ..... 271/221
5,192,141 3/1993 Chung et al. ..... 271/119 X

FOREIGN PATENT DOCUMENTS 0208324 1/1987 European Pat. Off. .

*Primary Examiner*—A. T. Grimley
*Assistant Examiner*—T. A. Dang
*Attorney, Agent, or Firm*—Tallam I. Nguti

[57] ABSTRACT

An intermediate sheet storage tray assembly for use in a reproduction apparatus includes a tray portion for receiving and holding tabbed sheets, and a feed device associated with a first edge of the tray portion for refeeding the tabbed sheets out of the tray portion. The intermediate sheet storage tray assembly further includes a mechanism for rotating the tray portion about a vertical axis so that the tabbed sheets in the tray portion are refed out of the tray portion even-edge first.

4 Claims, 5 Drawing Sheets

FIG. 2A
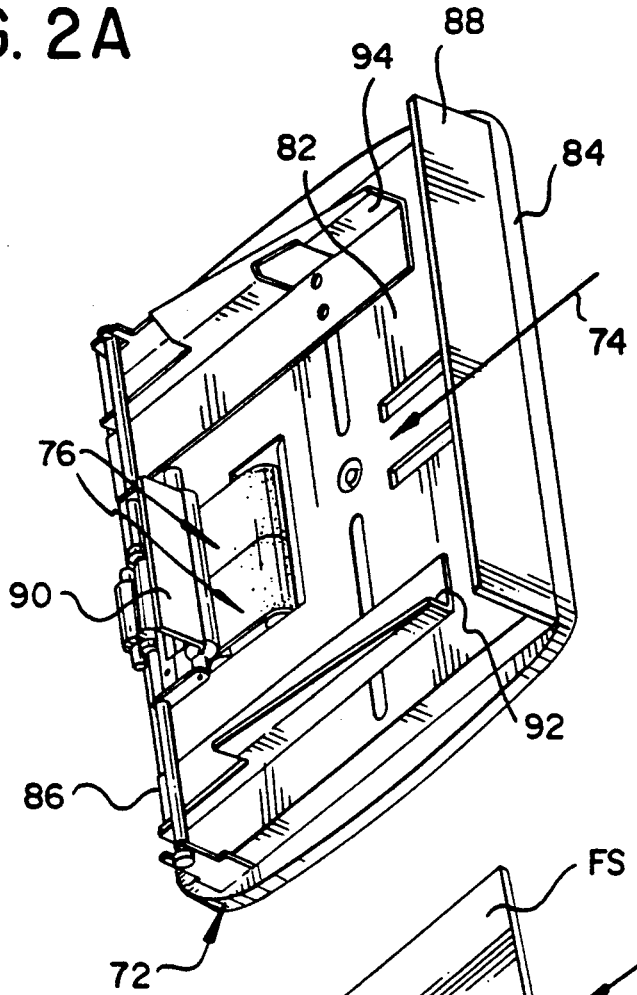
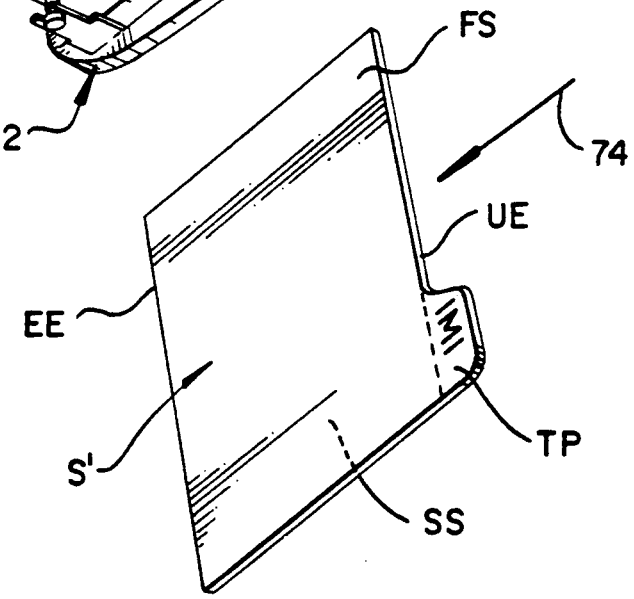
FIG. 2B

REPRODUCTION APPARATUS HAVING A TAB STOCK FEEDING INTERMEDIATE STORAGE TRAY ASSEMBLY

BACKGROUND OF THE INVENTION

1. Field of the Invention

This invention relates to reproduction apparatus such as copiers and printers, and more particularly to such a reproduction apparatus having an intermediate storage tray assembly capable of proper and automatic feeding of tabbed sheets, for example tab stock.

2. Background Art

Reproduction apparatus such as copiers and printers are well known for producing toned images on first and/or second sides of a suitable sheet. As disclosed for example in EPO Patent No. 0 208 324, issued Oct. 31, 1990 to Eastman Kodak; in U.S. Pat. No. 4,819,021, issued to Doery, on Apr. 4, 1989; and in U.S. Pat. No. 4,974,035, issued to Rabb et al on Nov. 27, 1990, such suitable sheets may include tabs or tabbed sheets. Tabbed sheets or tab stock are sheets which have an even edge and an uneven edge that includes a short projection portion extending beyond the rest of that edge. Such tabbed sheets or tab stock are useful for separating or producing divisions in a set of copy sheets. As disclosed in the EPO patent 0 208 324, methods and apparatus are known for printing directly on at least one side of the tab portion of a tabbed sheet. In order to enable proper registration and efficient handling of a tabbed sheet in such a reproduction apparatus, the tabbed sheet ordinarily is moved even-edge first, which means that the tabbed edge is therefore a trailing edge.

However, when it is desirable to print on both sides of a tabbed sheet, for example on both sides of the tabbed portion of such a sheet, devices such as a sheet side inverter and an intermediate or duplex sheet storage tray will have to be utilized. Unfortunately, however, such devices typically operate to reverse the order of lead and trail edges of the sheets. The result ordinarily therefore is that tabbed sheets in the duplex sheet storage tray will have the uneven or tabbed edge as their lead edge. Attempting to feed or refeed such tabbed sheet as such (uneven-edge first) from the duplex tray will doubtless result in skewing with significant image misregistration or jams.

SUMMARY OF THE INVENTION

It is, therefore, an object of the present invention to provide for use in a reproduction apparatus capable of producting duplex copies an intermediate sheet storage tray assembly capable of receiving tabbed sheets, and of refeeding such tabbed sheets even-edge first.

In accordance with the present invention, an intermediate sheet storage tray assembly for use in a reproduction apparatus includes a tray portion for receiving and holding tabbed sheets, and feed means associated with a first edge of the tray for refeeding the tabbed sheets out of the tray portion. The intermediate sheet storage tray assembly further includes means for rotating the tray portion about a vertical axis so that the tabbed sheets in the tray portion are refed even-edge first out of the tray portion.

BRIEF DESCRIPTION OF THE DRAWINGS

In the detailed description of the invention as presented below, reference is made to the drawings, in which:

FIG. 2A is a view in perspective of the sheet storage tray portion of the sheet storage tray assembly, in the tabbed sheet receiving orientation of FIG. 1A;

FIG. 2B is an illustration of a tabbed sheet in an orientation for receipt into the tray portion of FIG. 2A;

DETAILED DESCRIPTION OF THE INVENTION

Because electrostatographic reproduction machines and development apparatus for use therein are well known, the present description will be directed in particular to elements thereof which form part of or cooperate more directly with the present invention. Elements thereof not specifically shown or described herein are assumed selectable from those known in the prior art.

Figure 1A:
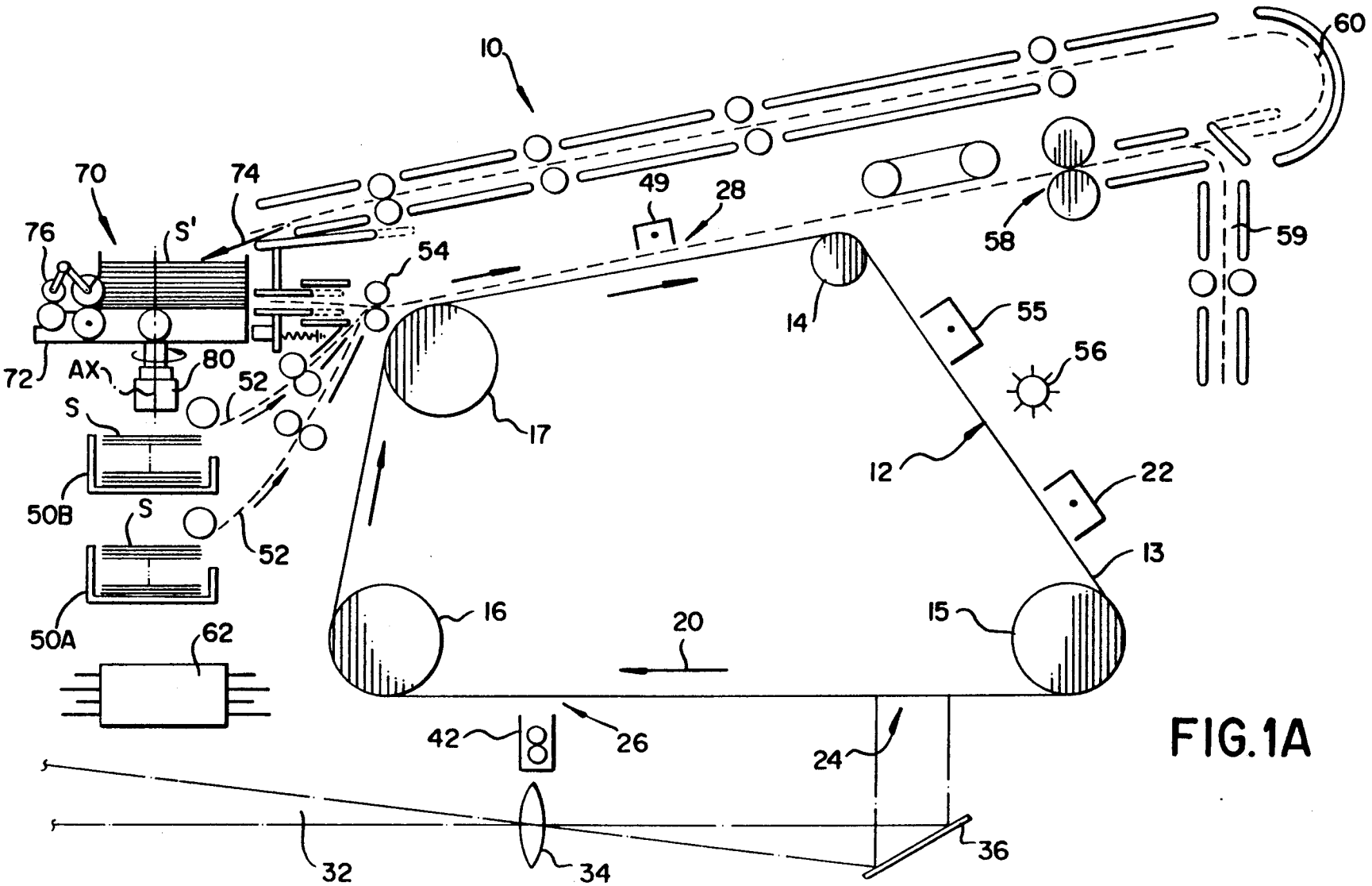
FIG. 1A is a schematic illustration of a reproduction apparatus including the sheet storage tray assembly of the present invention shown in a tabbed sheet receiving orientation.
Figure 1B:
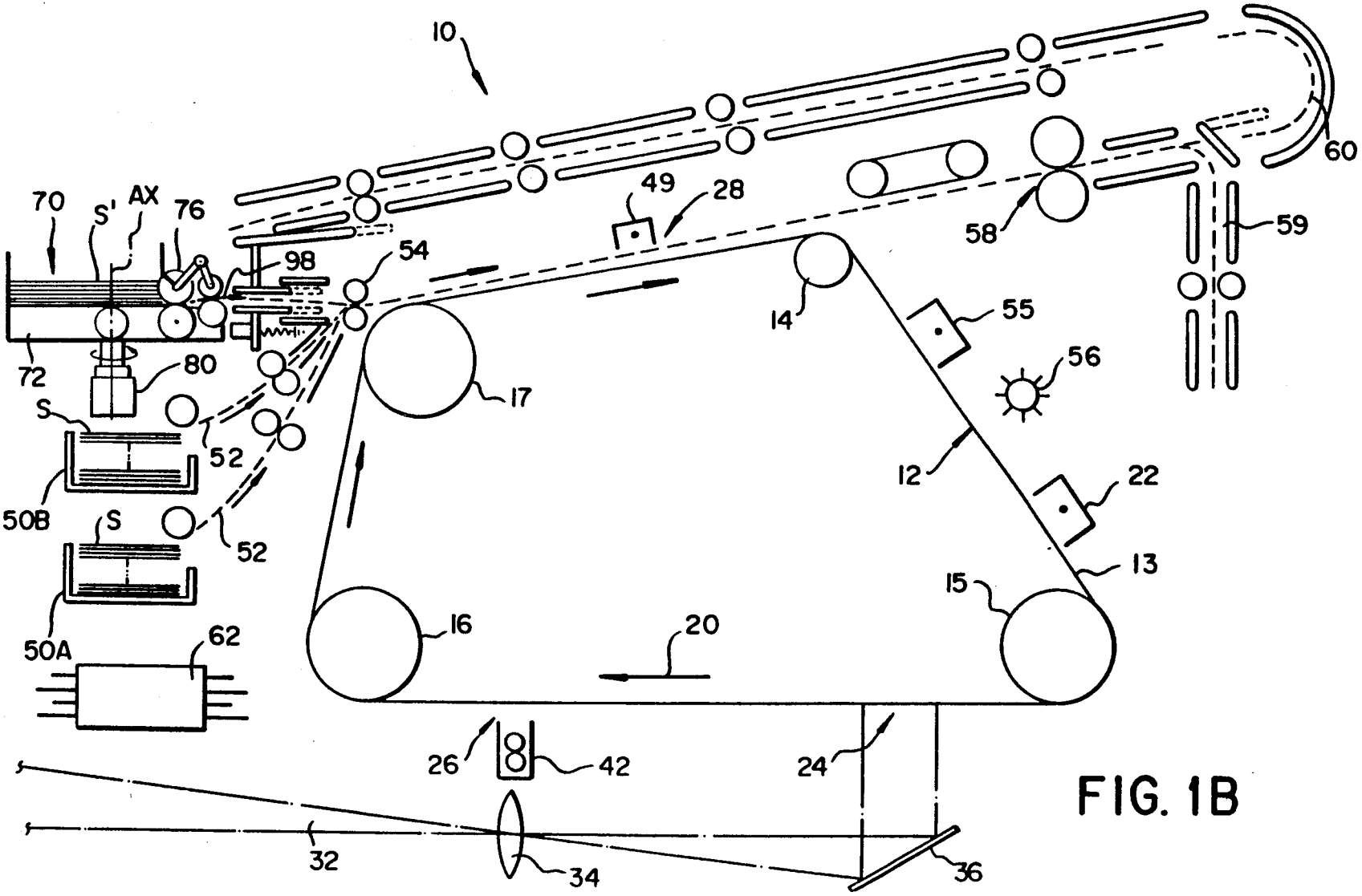
FIG. 1B is similar to FIG. 1A but showing the sheet storage tray assembly therein in a tabbed sheet refeeding orientation.

Referring now to FIGS. 1A and 1B, an exemplary electrostatographic reproduction apparatus such as a copier is designated generally by the numeral 10 and is suitable for producing copies of an original image on suitable copy sheets. As shown, the reproduction apparatus 10 includes an image-bearing member 12 having a front surface 13 with imaging and non-imaging areas. The member 12 can be a rotatable rigid drum or, for example, it can be a photoconductive web which as shown is trained about a series of transport rollers 14, 15, 16 and 17. The roller 14 is a drive roller and is coupled to a motor (not shown) for driving the member 12 in the direction, for example, of the arrow 20. Such movement of the member 12 causes successive imaging areas of the front surface 13 thereto to sequentially pass a series of electrostatographic process stations. As shown, such process stations include a charging station 22 at which each imaging area of the surface 13 receives a uniform layer of electrostatic charges. After the charging station 22, the other stations include an exposure station 24, a development station 26 and an image-transfer station 28.

At the exposure station 24, light rays 32 reflected from an original document (not shown) is projected through a lens-shutter system 34 and an image mirror 36 onto a selected imaging area of the charged surface 13 of the member 12. Such a light projection imagewise dissipates portions of the charged imaging area to form thereon a latent electrostatic image of the original document. As is also well known in the art, such imagewise exposure or dissipation of the uniform charge of the imaging areas of the surface 13 may also be achieved by means for example of an electronic write head (not shown).

The latent electrostatic image formed at the exposure station 24 is thereafter developed, that is, made visible with marking or toner particles at the development station 26. As shown, the development station 26 may include at least a development apparatus such as a magnetic brush apparatus 42. The magnetic brush apparatus 42 is positioned adjacent the surface 13 for applying charged toner particles which adhere to the electrostatic latent image to form a developed or toner image on such surface 13.

At the transfer station 28, the developed or toner image is transferred from the surface 13 onto a selected copy sheet S, for example a tabbed sheet, by electrostatic means that include a corona charger 49. The sheet S is supplied for example from one of the sheet supply units shown as 50A, 50B by transport means shown as 52. The tabbed sheet S is supplied, as such, in timed registration with the moving toner image on the surface 13, by a registration gate 54 for receiving such toner image, properly registered at the transfer station 28. After such toner image transfer, the transferring area of the surface 13 then moves past a cleaning assist charger 55, and a cleaning element 56 which removes any residual particles from such area, thus cleaning and preparing the area for reuse.

Meanwhile, the tabbed sheet S (now S' carrying the transferred toner image thereon) is moved through a fusing station 58 where the toner image is fixed to the sheet, and ordinarily then along the path 59 into an output device (not shown). Alternatively, the image carrying sheet S' after moving through the fusing station 58 is moved instead along an inverting path 60 and into an intermediate sheet storage tray, such as the tray of the sheet storage tray assembly of the present invention shown generally as 70 (and to be described in detail below). Typically, this is done when the reproduction apparatus 10 is operating in a duplex (or two-sided sheet copying) mode. In this (duplex) mode, the sheets S' eventually is refed (FIG. 1B) in the manner of the present invention (to be detailed below) from the tray assembly 70, through the registration gate 54 and back to the transfer station 28 for receiving a second toner image on the other side of the sheet from the first toner image. It should be noted that when running non-tabbed sheets, the intermediate duplex storage tray 70 remains in the position of FIG. 1B while receiving sheets S' and while refeeding such sheets back to the registration gate as above.

For monitoring and controlling the operation of the various stations and elements of the reproduction apparatus 10, the apparatus 10 includes a logic and control unit (LCU) 62. As is well known, the LCU 62 comprises stored programs which control machine functions, and which are utilized to sequentially actuate and deactuate operative elements of each of the process stations in response to monitored input signals. The LCU 62, for example, also comprises input/output circuit boards, a bus structure consisting of a series of addresses, data and control signal lines, and a central processing unit (CPU). The CPU, for example, includes a test point, communication chips and two microprocessors, such as an INTEL8032 and an INTEL80286 which are used for memory storage, for communication with other dedicated microprocessors within the apparatus 10, and for controlling all other functions of the apparatus 10 that are not controlled by a dedicated microprocessor, The second microprocessor of the CPU, for example, the INTEL80286 includes ROM, RAM and one-time programmable features, and is used for temporary storage of information generated by the CPU for machine control.

Referring now to FIGS. 1A–4B, the intermediate sheet storage tray assembly 70 includes a tray portion 72 for receiving and holding tabbed sheets S' particularly shown as tabbed sheets that are each carrying a first fused toner image, for example 1M1, on a first side FS thereof. As shown, the first toner image 1M1 (FIGS. 2B and 3B) appears (as formed and transferred) on a tab portion TP of the sheet S'. As further shown, (FIGS. 2B, 3B) the tabbed sheet S' has an even edge EE, and a tabbed or uneven edge UE that includes the tab portion TP. Referring in particular to FIGS. 1A and 2A, 2B, each tabbed sheet S' is fed into the tray assembly 70 in a direction represented by the arrow 74 after inversion along the sheet path 60. As such, each tabbed sheet S' is being fed into the tray assembly 70 with its even-edge EE leading, and with its first side FS facing up. It should be noted that prior to inversion in the path 60 as above, each tabbed sheet was supplied from the supply 50A, 50B with its even edge EE leading and with its first side FS facing down not up. Again, referring to FIGS. 1A–4B, the intermediate sheet storage tray assembly 70 of the present invention further includes a feed means or device 76 for refeeding sheets out of the tray portion 72, as well as, a mechanism 80 for supporting and rotating or indexing the tray portion 72.

Figure 3A:
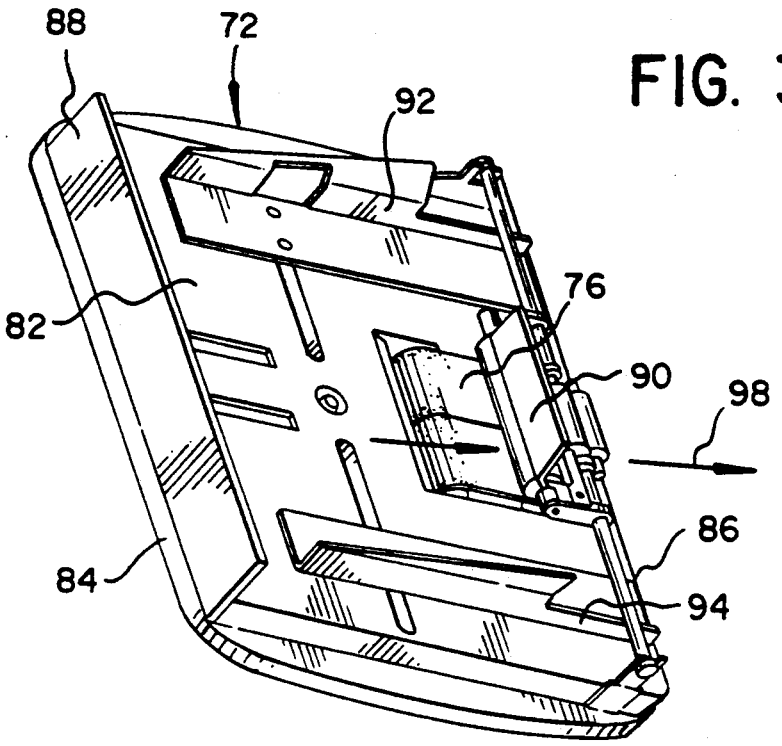
FIGS. 3A and 3B are similar to FIGS. 2A and 2B but in the tabbed sheet refeeding orientation of FIG. 1B.

The tray portion 72 has a sheet holding surface 82, a rear edge 84, and a front edge 86 (FIGS. 2A, 3A). In the sheet receiving orientation, sheets are fed even-edge EE first and first side FS facing up over a rear guide 88 onto the holding surface 82. The rear guide 88 is adjustable and is adjusted such that the leading or even-edge EE of a stack of sheets on the surface 82 will be aligned along a front guide 90 that is positioned over the feed device or feed means 76. The stack of sheets on the surface 82 is also aligned sideways relative to the feed means 76 by adjustable side guides 92, 94. As shown, the feed means 76 are associated with the front edge 86 of tray portion 72 for refeeding sheets from the surface 82 out of tray portion 72.

Referring in particular to FIGS. 1A, 1B and 4A, 4B, the intermediate sheet storage tray assembly 70 further includes the means 80 for supporting and selectively rotating the tray portion 72, substantially 180° at least, about a vertical axis AX. Such rotation is performed so as to enable the tray assembly 70 to always refeed tabbed sheets S' even-edge EE first. As shown, the supporting and rotating means 80 include a motor 96 that is appropriately coupled for example in a conventional manner to the base of the tray portion 72.

Figure 3B:
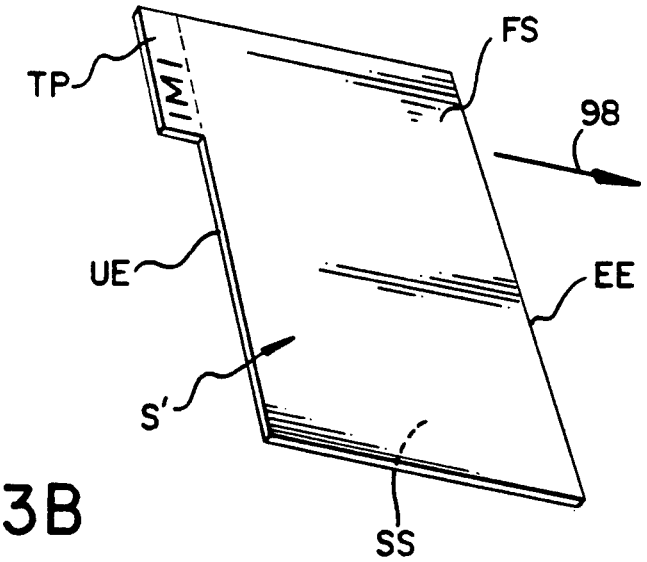
Figure 4A:
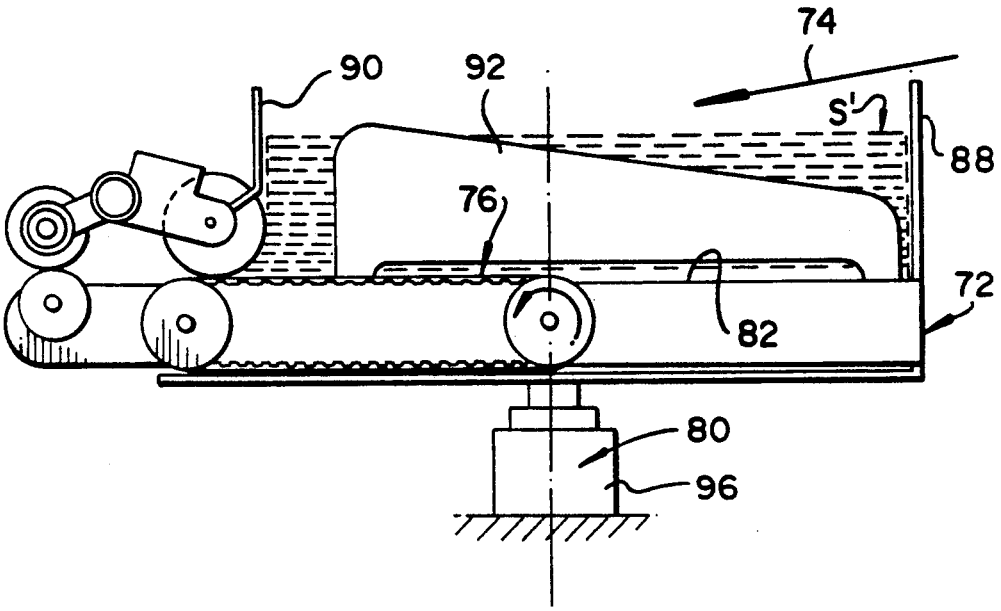
FIGS. 4A and 4B are side views each of the sheet storage tray assembly of FIGS. 1A and 1B, respectively.
Figure 4B:
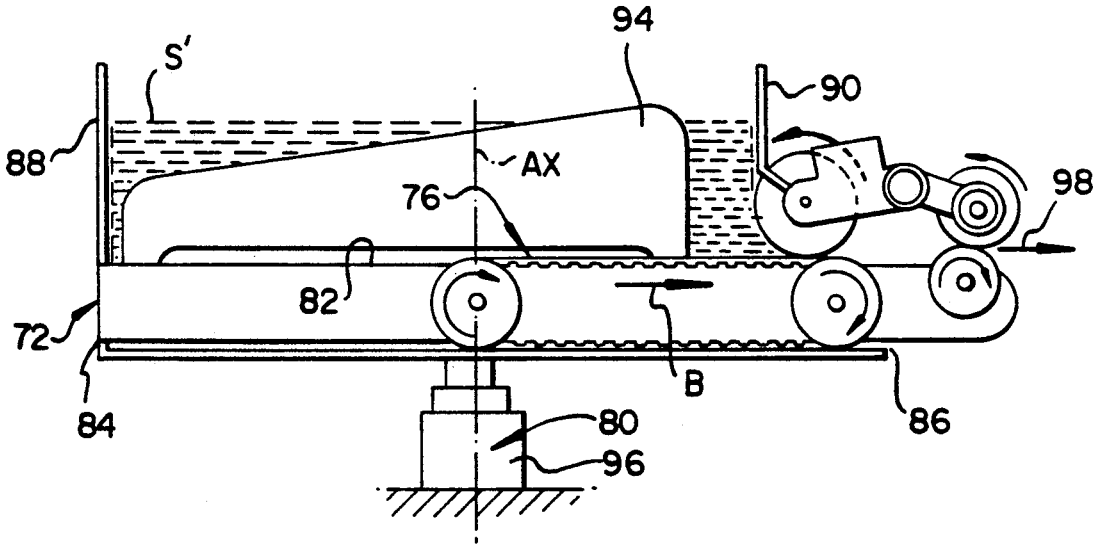

Operatively, for running tabbed sheets, the tray assembly 70 is first rotated substantially 180° into a tabbed sheet receiving orientation and position (FIGS. 1A, 2A and 4A) in which the front 86 of the tray portion 72 is to the left (of the drawings as shown); that is, further away from incoming sheets shown by the arrow 74. A set of sheets (tabbed sheets) fed even-edge EE first, and first side FS up, come in as shown by the arrow 74 (over the rear guide 88) onto the surface 82 to form a stack thereon. When feeding of the set of sheets as such onto the surface 82 is completed, the rotating means 80 (under the control of the LCU 62) rotates the tray portion 72, substantially 180° such that the tray portion is then in a tabbed sheet refeeding orientation or position (FIGS. 1B, 3B and 4B). The tabbed sheet refeeding position as shown is achieved when the front 86 of the tray portion 72 is to the right (of the drawings) as shown. Tabbed sheets held temporarily on the surface 82 can then be refed even-edge EE first and second side SS down (FIG. 3B) as shown by the arrow 98 through the registration gate 54 for receiving another (second image) on the second side SS of the sheet S' at the transfer station 28 (FIG. 1B). After receiving the second image as such the sheet is again passed through the fusing station 58 and then along the path 59 to an output unit (not shown).

As can be seen, a reproduction apparatus has been shown in which is provided an intermediate sheet storage tray assembly that is capable of receiving tabbed sheets fed even-edge first during a duplex copying operation into a tray portion thereof, and that is capable of refeeding such tabbed sheets even-edge first out of such tray portion for receiving a second image on a second side of each such sheet.

The invention has been described in detail with particular reference to preferred embodiments thereof, but it will be understood that variations and modifications can be effected within the spirit and scope of the invention.

What is claimed is:

1. For use in a reproduction apparatus, an intermediate sheet storage tray assembly for holding and refeeding tabbed sheets, the intermediate sheet storage tray assembly comprising:

(a) a tray portion for receiving and holding tabbed sheets having an even-edge and an uneven edge each, said tray portion having a rear edge and a front edge;

(b) feed means, associated with said front edge of said tray portion, for refeeding said tabbed sheets out of said tray portion; and (c) means for rotating said tray portion about a vertical axis so that tabbed sheets in said tray portion are refed therefrom even-edge first.

2. The storage tray assembly of claim 1 wherein said tray portion is rotatable substantially 180°.

3. The storage tray assembly of claim 1 wherein said rotating means includes means for rotating said tray portion substantially 180° to receive tabbed sheets being fed thereinto even-edge first, and for thereafter rotating said tray portion substantially 180° to a tabbed sheet refeeding position wherein said tabbed sheets are refed even-edge first out of said tray portion.

4. A reproduction apparatus comprising:

(a) means for forming and transferring a first toner image and a second toner image at a transfer station to a tabbed sheet;

(b) means for feeding a tabbed sheet having a first, even-edge, and a second opposite uneven-edge including a tab portion, to said transfer station to receive said first toner image on a first side of said tab portion;

(c) an intermediate sheet storage tray or receiving and refeeding said tabbed sheet to said transfer station to receive said second toner image on a second side of said tab portion; and (d) means for rotating said intermediate storage tray about a vertical axis so that said tabbed sheet received into said intermediate storage tray is refed even-edge first out of said storage tray.

* * * * *